United States Patent [19]

Koch et al.

[11] 4,300,727

[45] Nov. 17, 1981

[54] MANDREL FOR A BALL WINDING MACHINE

[75] Inventors: Manfred Koch, Pfäffikon; Ernst Bosshard, Hinwil, both of Switzerland

[73] Assignee: G & W Machinery Inc., Pfaffikon, Switzerland

[21] Appl. No.: 53,414

[22] Filed: Jun. 28, 1979

[51] Int. Cl.[3] ..... B65H 54/64; B65H 75/24

[52] U.S. Cl. ..... 242/2; 242/53; 242/110.1

[58] Field of Search ..... 242/2, 53, 110.1, 110.2, 242/110, 46.2, 46.3, 46.4, 72, 72.1, 68.2

[56] References Cited

U.S. PATENT DOCUMENTS

| | | | |
|---|---|---|---|
| 833,481 | 10/1906 | Paugh | 242/72.1 |
| 1,901,226 | 3/1933 | Carter | 242/110.1 |
| 1,928,979 | 10/1933 | Levison | 242/110.1 X |
| 2,306,466 | 12/1942 | Patterson | 242/72.1 X |
| 2,403,147 | 7/1946 | Westergaard | 242/56.6 |
| 4,124,171 | 11/1978 | Lucke | 242/2 |

FOREIGN PATENT DOCUMENTS

| | | | |
|---|---|---|---|
| 72267 | 4/1916 | Switzerland | 242/110.2 |
| 172782 | 12/1921 | United Kingdom | 242/2 |

*Primary Examiner*—Stanley N. Gilreath

[57] ABSTRACT

A mandrel for winding yarn having a plurality of sets of articulated arms rotatable about a central axis. Each set of arms is movable radially between a first position in which the sets define a generally cylindrically shape of small diameter and second position defining a generally cylindrical shape of larger diameter. A plurality of fingers are arranged respectively between selective adjacent sets so as to define a generally cylindrical shape having a diameter intermediate the small and larger diameter.

3 Claims, 4 Drawing Figures

MANDREL FOR A BALL WINDING MACHINE

BACKGROUND OF THE INVENTION

The present invention relates to a mandrel for use in winding a ball of yarn, thread or the like, in particular to an improved mandrel for use in high speed ball winding machines for hand knitting yarns.

Mandrels for use in automatic ball winding machines are well known, as reference to Swiss Patent No. 544,716, British Patent No. 172,782 and German Patent Nos. 1,061,668 and 1,074,458 will show. Such mandrels generally consist of a collapsible frame comprising several links radially spaced about a central axis which are connected together to form a trapeze when opened. During the winding process the yarn is laid on the open frame and once the winding is complete the mandrel is closed thereby reducing the diameter and allowing the ball that has been wound to be removed.

In winding yarns, particularly yarns which are brushed or of the mohair type having small fibers extending from the main body of the yarn, the conventional type of mandrel has a decided disadvantage in that the fibers tend to get trapped between the various joints of the links. As a result, the inner part of the wound ball snags on the collapsed frame and is pulled out from the remainder when the ball is removed or doffed from the mandrel.

It has been attempted to avoid this problem by equipping the known mandrels with a fabric bag covering the various joints. This solution has its limitations in that the friction between the fabric and the yarn of the ball, under winding tension, still contributes to the snagging of the ball and continues to result in the inner part of the ball being pulled out while being doffed. Furthermore, the life of such a bag is very small due to the mechanical action of opening and closing the mandrel, and the friction of removing the wound ball. Considerable down time therefore occurs in order to periodically inspect the fabric bag, and for its replacement.

SUMMARY OF THE INVENTION

According to the present invention the foregoing problems are eliminated by providing a cylindrical sleeve comprising s series of fingers extending almost the entire length of the collapsed mandrel, which fingers are spaced from each other and located circumferentially between adjacent ones of the links of the mandrel frame. The diameter defined by the sleeve of fingers is greater than the diameter of the collapsed frame but less than the diameter of the open frame. As a result, the fingers will not interfere with the actual winding of the ball, but will provide a sleeve of greater diameter than the collapsed mandrel which maintains the wound ball out of contact with the joints and links of the frame permitting the ball to be removed without contact with those joints and links.

Full details of the present invention are set forth in the following description and shown in the accompanying drawings.

DESCRIPTION OF THE INVENTION

Figure 1:
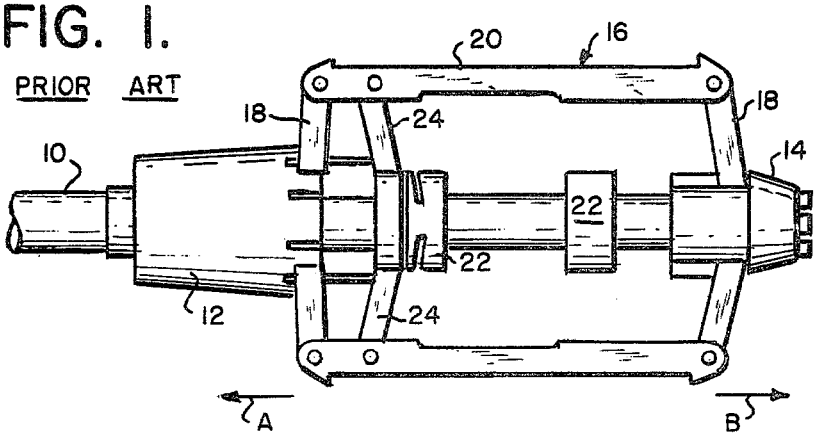
FIG. 1. PRIOR ART
FIG. 1 is a plan view of a prior art mandrel in open position.
Figure 2:
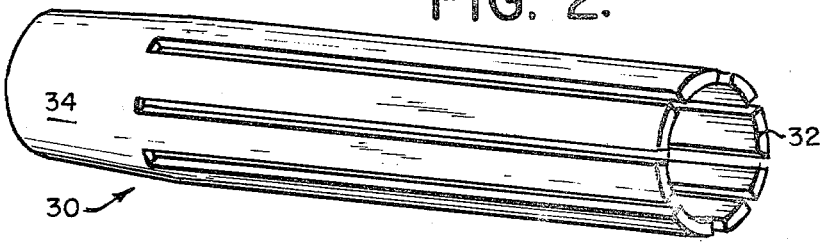
FIG. 2 is a perspective view of the fingered sleeve of the present invention.

As seen in the drawing, the mandrel comprises a collapsible frame structure having a central supporting and actuating rod 10 extending freely through a collar 12. At the upper end of the rod there is fixed a hub 14. Between the collar 12 and the hub 14 are located a plurality of sets of articulating link arms 16, the sets being arranged uniformly about the axis of the central rod. Each set of arms comprises a pair of short arms 18, pivotally secured at one end to the respective collar and hub, within a slot, and at its other end to an elongated arm 20 arranged generally parallel to the axis of the rod. Fixed to the rod 10 between the collar 12 and the hub 14 and spaced from each other are a pair of bosses 22, at least one of which is provided with actuating connectors 24 jointed to each of the elongated arms at adjacent respective pivot point with the short arm. The entire set of arms, connections and central rod are arranged so that on movement of the collar 12 relative to the rod 10 in a downward direction indicated by the arrow A, each of the set of link arms collapse radially inwardly about the central rod and on movement of the collar relative to the rod in the upward direction, arrow B, the set of links move radially outwardly to define a cylindrical figure of rotation having a trapeze shape about the central rod on which the yarn may be wound.

The central rod is driven so as to be rotatable about its own axis. On the other hand, the collar or hub may be driven. In any event, due to the fixed connection between the hub 14 and the rod 10, the entire frame will thus rotate. The collar 12 is connected to a link actuating system which will cause its selective reciprocating motion along the axis of the rod 10. On the other hand, the rod may be actuated while the collar is held. In this manner the frame can be opened and collapsed as desired, much in the manner as an umbrella frame.

It will be observed, that the frame has a significantly larger diameter in the open condition than in the closed condition and that in the closed condition the links are drawn inwardly tightly with respect to each other as well as with the rod and collar. It is the latter condition which creates the problem which the present invention seeks to overcome in that when the yarn is wound, upon the open frame as seen in FIG. 1, and then the frame is collapsed, prior to removal or doffing, the inner yarns tend to catch and snag between the links and in the pivot joints.

Figure 3:
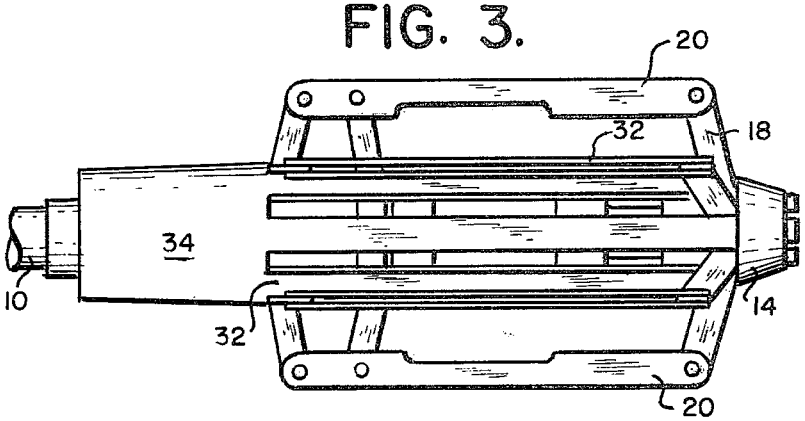
FIG. 3 is a plan view of an open mandrel embodying the present invention.

To overcome this problem, the present invention provides a sleeve 30 comprising a plurality of elongated flat blade-like fingers 32 which extend, as seen in FIG. 3, from the collar 12 so that the fingers extend respectively longitudinally between, i.e. within the space of adjacent link sets 16. The blades 32 are at least the length of the frame from collar 12 to hub 14, when the frame is in its open condition and may be even longer to extend the distance between the collar and the hub when the frame is in collapsed condition. The blades 32, having at least an arcuate outer surface, are attached to the collar so as to be fixed thereto and movable therewith and define a cylindrical sleeve the outer diameter of which is somewhat larger than the diameter of the frame when the frame is collapsed and smaller than the diameter of the frame when the frame is in its open condition.

Preferably, the fingers 32 are formed in the shape of a slotted cylindrical sleeve joined integrally at one end to a common supporting ring member 34, so as to extend cantilevered therefrom. The ring member 34 may be removably placed over the collar and secured by suitable screw means or keyed thereto. A preferable means of attachment, is forming the collar with a slot and forming the inner circumferential edge of the ring with a radial key or lug fitting therein. Depending on the size of the mandrel, one or more of the fingers may be eliminated, provided a generally cylindrical form is maintained.

The spaced fingers 32 of the cylindrical sleeve do not interfere with the opening or closing of the mandrel frame since it is attached only to the movable collar and the space between the fingers allows the movement of the link arms 16. The fingers and the entire sleeve, should be polished with no rough edges so as to avoid and damage to the yarn being wound.

Figure 4:
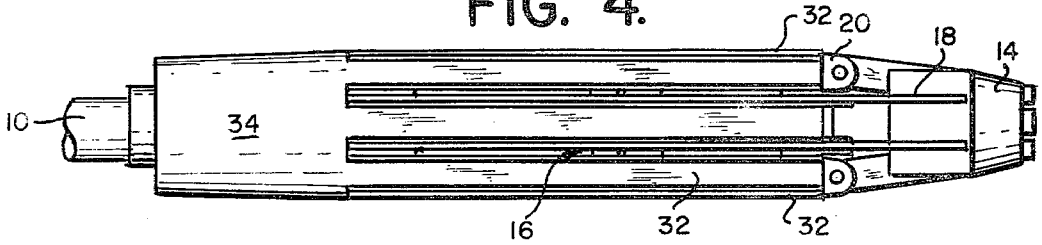
FIG. 4 is a plan view of the mandrel of FIG. 3 in closed condition.

On winding the yarn ball, the frame is in open condition as seen in FIG. 3 and the fingers 32 do not interfere with the yarn at all. However, on completion of the winding and collapse of the frame as seen in FIG. 4, the fingers of the sleeve, under tension of the wound ball of yarn gather together forming an almost complete cylindrical body the diameter of which is greater than that of the frame. However, since its diameter is larger than the collapsed linkage, the yarn is prevented from snagging or catching on the links or the pivot joints of the frame. The cylinder provides a generally smooth outer surface so that doffing or removal of the ball, by an axial pushing of the ball from the mandrel, is simple and easy. Unlike the conventional mandrel, the ball does not ride on the narrow edges of the longitudinal arms forming the frame. The cantilevered extension of the fingers being somewhat resilient tends to hold the ball tighter during its removal, since it prevents the total collapse of the wound ball.

Various changes, modifications and other embodiments may be incorporated as a result of the knowledge of the present invention. It is therefore intended that the foregoing disclosure be taken as illustrative only and not limiting in any manner of the scope of the claims.

What is claimed is:

1. A mandrel for winding yarn into self-supporting balls comprising a central rod having a hub at one end, a collar freely movable axially over said rod and a plurality of sets of arms and connecting links pivotly secured between the hub and collar, and shiftable on movement of said collar relative to said rod from a first collapsed position having a small diameter to a second open position having a larger diameter, a plurality of flat blades having an arcuate exterior surface arranged concentrically about said central rod and spaced therefrom, each of said blades being respectively connected at one end to said collar extending cantilevered over said rod with the ends opposite said collar free of connection with each other and said hub and located between adjacent ones of said sets of arms and connecting links, said blades defining a radially resilient cylinder having a diameter intermediate the diameter defined by said arms and links in the first and second position open at the end opposite said collar to form a smooth surface from which yarn wound thereon can be easily doffed.

2. The mandrel according to claim 1, wherein said blades are integral with a ring at one end, said ring being located over said collar.

3. The mandrel according to claim 2, wherein said ring is removably secured to said collar.

* * * * *